US009072649B2

(12) United States Patent
LaFord

(10) Patent No.: US 9,072,649 B2
(45) Date of Patent: Jul. 7, 2015

(54) LIMB-SUPPORT ASSEMBLY FOR USE WITH AN ASSISTIVE DEVICE

(71) Applicant: Alan Ross LaFord, Renton, WA (US)

(72) Inventor: Alan Ross LaFord, Renton, WA (US)

( * ) Notice: Subject to any disclaimer, the term of this patent is extended or adjusted under 35 U.S.C. 154(b) by 127 days.

(21) Appl. No.: 13/801,359

(22) Filed: Mar. 13, 2013

(65) Prior Publication Data

US 2014/0261588 A1 Sep. 18, 2014

(51) Int. Cl.
*A61H 3/02* (2006.01)
*A61H 3/00* (2006.01)

(52) U.S. Cl.
CPC ..... *A61H 3/02* (2013.01); *Y10T 29/49826* (2015.01); *A61H 2003/005* (2013.01); *A61H 3/0288* (2013.01); *A61H 2003/004* (2013.01); *A61H 2003/006* (2013.01); *A61H 2003/0283* (2013.01)

(58) Field of Classification Search
CPC ..... A61H 2003/002; A61H 2003/004; A61H 2003/005; A45B 3/00
USPC ..... 135/65, 66
See application file for complete search history.

(56) References Cited

U.S. PATENT DOCUMENTS

| | | | | |
|---|---|---|---|---|
| 751,942 | A | 2/1904 | Renno | |
| 2,378,486 | A * | 6/1945 | Jones | 135/68 |
| 2,778,370 | A | 1/1957 | Chamblee | |
| 3,016,060 | A | 1/1962 | Beattie | |
| 4,058,119 | A | 11/1977 | Rosequist | |
| 4,291,715 | A | 9/1981 | Monte | |
| 4,605,190 | A | 8/1986 | Kamp | |
| 4,722,356 | A * | 2/1988 | Rehder | 135/67 |
| 4,910,927 | A | 3/1990 | Beatty | |
| 5,291,909 | A * | 3/1994 | Skorman et al. | 135/67 |
| 5,941,263 | A | 8/1999 | Bierman | |
| 5,983,912 | A | 11/1999 | Leu | |
| 6,470,900 | B1 | 10/2002 | Hamilton | |
| 6,494,919 | B1 | 12/2002 | Matthews | |
| 6,604,472 | B2 * | 8/2003 | McNeil | 108/42 |
| 6,799,592 | B1 | 10/2004 | Reynolds | |
| 6,932,096 | B2 | 8/2005 | Marek | |
| 7,422,188 | B1 | 9/2008 | Schlosser | |
| 7,600,524 | B2 | 10/2009 | West | |
| D681,645 | S * | 5/2013 | Meadows et al. | D14/447 |
| 2003/0098051 | A1 * | 5/2003 | Fismer | 135/66 |
| 2011/0017901 | A1 | 1/2011 | Denburg et al. | |

OTHER PUBLICATIONS

"Freedom Crutch," Sep. 21, 2012, http://www.freedomcrutch.com.

* cited by examiner

*Primary Examiner* — David R Dunn
*Assistant Examiner* — Danielle Jackson
(74) *Attorney, Agent, or Firm* — John W. Branch; Lowe Graham Jones PLLC

(57) ABSTRACT

A limb-support assembly for use with an assistive device includes a weight-bearing member having a first edge. The weight-bearing member includes a planar receiving surface configured for receiving a user's lower limb. A mounting assembly is configured for removably coupling the weight-bearing member to an assistive device. The mounting assembly includes a first mounting brace extending outwardly from the first edge of the weight-bearing member and above the receiving surface. A mounting aperture is defined in the weight-bearing member between the first mounting brace and the receiving surface. The mounting aperture is configured for receiving a portion of the assistive device. When a portion of the assistive device is received by the mounting aperture, and when weight is placed on the receiving surface, the first mounting brace is configured to press against an opposing side of the assistive device from the receiving surface.

18 Claims, 12 Drawing Sheets

LIMB-SUPPORT ASSEMBLY FOR USE WITH AN ASSISTIVE DEVICE

FIELD

The present invention is directed to the area of assistive-device systems. The present invention is also directed to limb-support assemblies for coupling with assistive devices and providing limb support for users of the assistive devices, as well as methods of making and using the limb-support assemblies and assistive devices.

BACKGROUND

People with a reduced ability to stand or walk may sometimes use assistive devices to facilitate mobility (e.g., standing, walking, or the like). Assistive devices may provide a rigid support for unburdening a person from at least a portion of their own weight, thereby enabling the user to stand or walk longer than they would otherwise be able.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Detailed Description, which is to be read in association with the accompanying drawings, wherein.

DETAILED DESCRIPTION

The present invention is directed to the area of assistive-device systems. The present invention is also directed to limb-support assemblies for coupling with assistive devices and providing limb support for users of the assistive devices, as well as methods of making and using the limb-support assemblies and assistive devices.

Assistive devices include devices for assisting a user with standing, or walking, or both (e.g., crutches, canes, walkers, or the like). In some instances, assistive devices may be used as a single device (e.g., a cane, or the like). In other instances, assistive devices may be used in pairs (e.g., crutches, or the like). Assistive devices may include one or more base members and a body support assembly. The body support assembly may include one or more body supports (e.g., axillary supports, forearm supports, hand supports, or the like or combinations thereof). Optionally, the body support assembly may include one or more support members (e.g., first and second support members, or the like) that couple the one or more body supports to the one or more base members.

Users of assistive devices may sometimes experience discomfort (e.g., pain, fatigue, or the like) when using the assistive devices. In some instances, the user discomfort may be alleviated by elevating a lower limb. Unfortunately, elevating a lower limb may involve removing the assistive devices and finding a suitable location to sit down with ample space to elevate the lower limb. Removing the assistive device and finding a suitable location to sit down and elevate the lower limb may be inconvenient, or not possible. In which case, the user of the assistive device may need to endure the discomfort for an extended period of time.

As herein described, an assistive system includes a limb-support assembly coupleable to an assistive device. The limb-support assembly enables a user of an assistive device to elevate one of his or her lower limbs while using the assistive device. In at least some embodiments, the limb-support assembly is removably coupleable to the assistive device so that the user can use the limb-support assembly when desired, and remove the limb-support assembly when not desired. Additionally, when the limb-support assembly is coupled to an assistive device, the limb-support assembly may also be used as a portable seat to rest upon, or a platform to elevate a lower limb when sitting on a chair or bench.

The limb-support assembly is consistently described herein as configured and arranged for coupling to a crutch with an axillary support. It will be understood that a crutch with an axillary support is merely used as an example of an assistive device to which the limb-support assembly is coupleable, and is not intended to be limiting.

Figure 1:
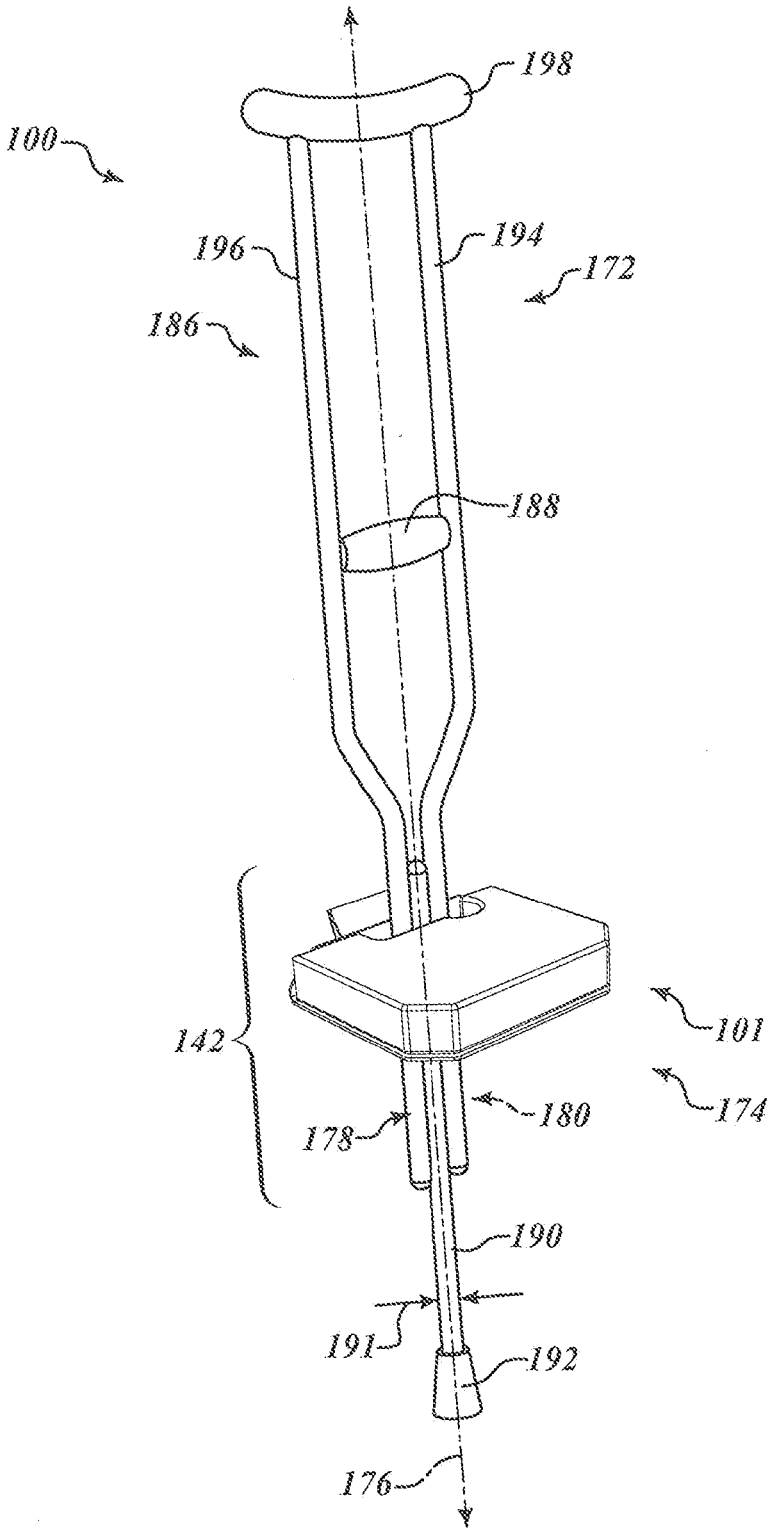
FIG. 1 is a schematic perspective view of one embodiment of a limb-support assembly coupled to an assistive device, according to the invention.

FIG. 1 illustrates one embodiment of an assistive system 100 that includes a limb-support assembly 101 coupled to a crutch 186. In FIG. 1, the crutch 186 is shown having a first end portion 172, an opposing second end portion 174, a longitudinal axis 176, a first side 178, and an opposing second side 180. A body support, such as an axillary support 198, is disposed along the first end portion 172. One or more support members, such as first support member 194 and second support member 196, are coupled to the body support 198 and extend longitudinally along the first end portion 172. Optionally, a hand support 188 is coupled to at least one of the first support member 194 or the second support member 196.

The crutch 186 includes one or more base members, such as base member 190, extending longitudinally along the second end portion 174. The base member 190 has a diameter 191. The base member 190 is coupled to one or more of the support beams 194 and 196. In at least some embodiments, the assistive device 186 is formed such that the base member 190 couples to the support beams 194 and 196 along an overlapping region 142 where a portion of the base member 190 is sandwiched between portions of the support beams 194 and 196.

Optionally, a base tip 192 is disposed at a lateral-most end of the base member 190. In at least some embodiments, the base tip 192 is permanently attached to the base member 190. The base tip 192 may be formed from any material (e.g., rubber, plastic, or the like) suitable for absorbing shock during use of the assistive device 186 and also for providing protection for the base member 190 from continual contact with the ground during use. In at least some embodiments, the base tip 192 has a diameter (1299 in FIG. 12) that is larger than the diameter 191 of the base member 190.

Figure 2:
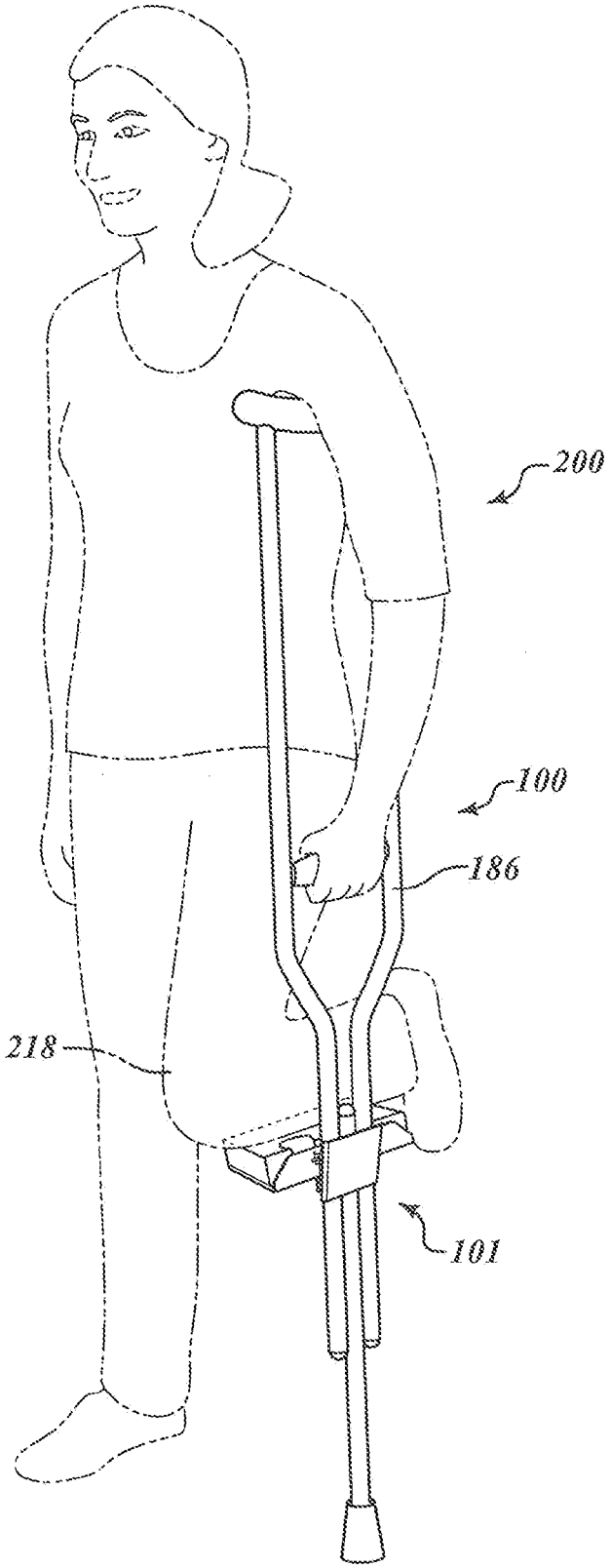
FIG. 2 is a schematic perspective view of one embodiment of a user using the assistive device of FIG. 1 while resting one of her lower limbs on the limb-support assembly of FIG. 1 that is coupled to the assistive device, according to the invention.

FIG. 2 shows a user 200 using the assistive system 100. A lower limb 218 of the user 200 is disposed on the limb-support assembly 101. In FIG. 2, a distal portion (e.g., knee, shin, ankle, foot, or the like or combinations thereof) of the user's lower limb 218 is shown resting on the limb-support assembly 101 with the distal portion of the user's lower limb 218 extending in a direction that is perpendicular (or approximately perpendicular) to the longitudinal axis 176 of the assistive device 186. In other words, the user's lower limb is elevated when the longitudinal axis 176 of the assistive device 186 is in a vertical orientation. It may be advantageous for the limb-support assembly 101 to receive the user's lower limb 218 such that the distal portion of the user's lower limb 218 extends in a direction that is perpendicular (or approximately perpendicular) to the longitudinal axis 176 of the assistive device 186 so that, during use of the assistive device 186, the distal portion of the user's lower limb 218 is elevated from the ground, thereby potentially reducing patient discomfort. Additionally, such positioning may prevent blood from pooling at the user's foot.

FIGS. 1 and 2 (and other figures) show the assistive device as a single crutch. It will be understood that, in the case of crutches, a pair of crutches may often be used. It may be advantageous to use the limb-support assembly with multiple crutches (as well as with a single crutch) to facilitate distribution of a user's weight. Improved weight distribution may enhance balance and maneuverability. Improved weight distribution may also relieve pressure along the one or more body supports, such as the axillary supports 198, hand supports 188, or the like.

In at least some embodiments, the limb-support assembly 101 is removably coupleable to the assistive device 186. In at least some embodiments, the positioning of the limb-support assembly 100 along the longitudinal axis 176 of the assistive device 186 is adjustable. It may be advantageous for the positioning of the limb-support assembly 100 along the longitudinal axis 176 of the assistive device 186 to be adjustable in order to comfortably accommodate users 200 of various heights.

Figure 3:
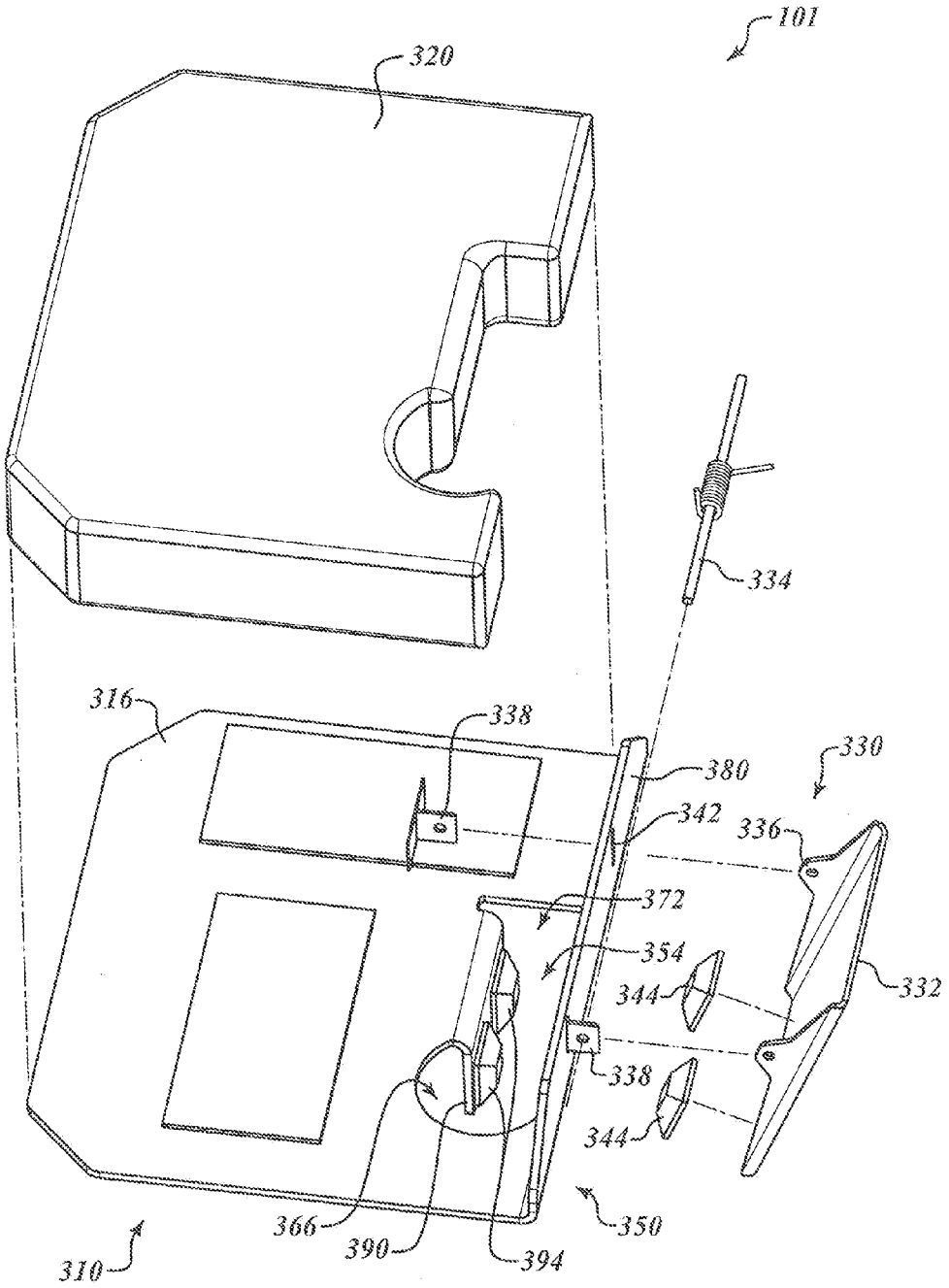
FIG. 3 is a schematic exploded perspective view of one embodiment of the limb-support assembly of FIG. 1, according to the invention.
Figure 4:
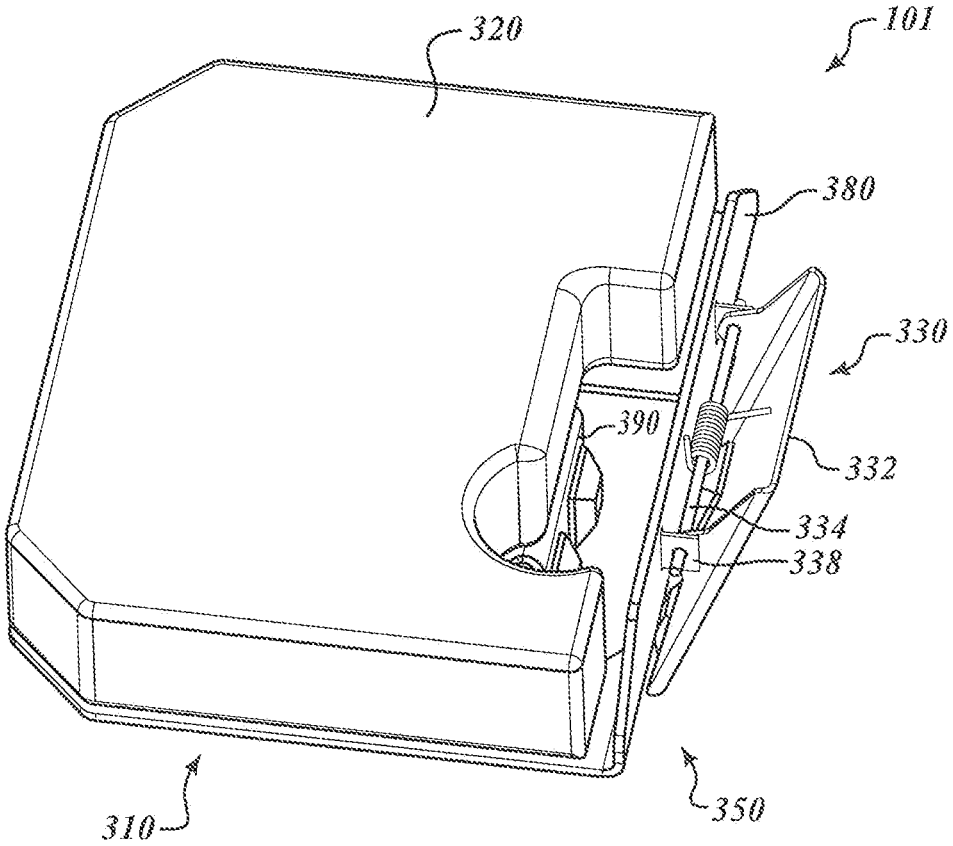
FIG. 4 is a schematic perspective view of one embodiment of the limb-support assembly of FIG. 3, according to the invention.
Figure 12:
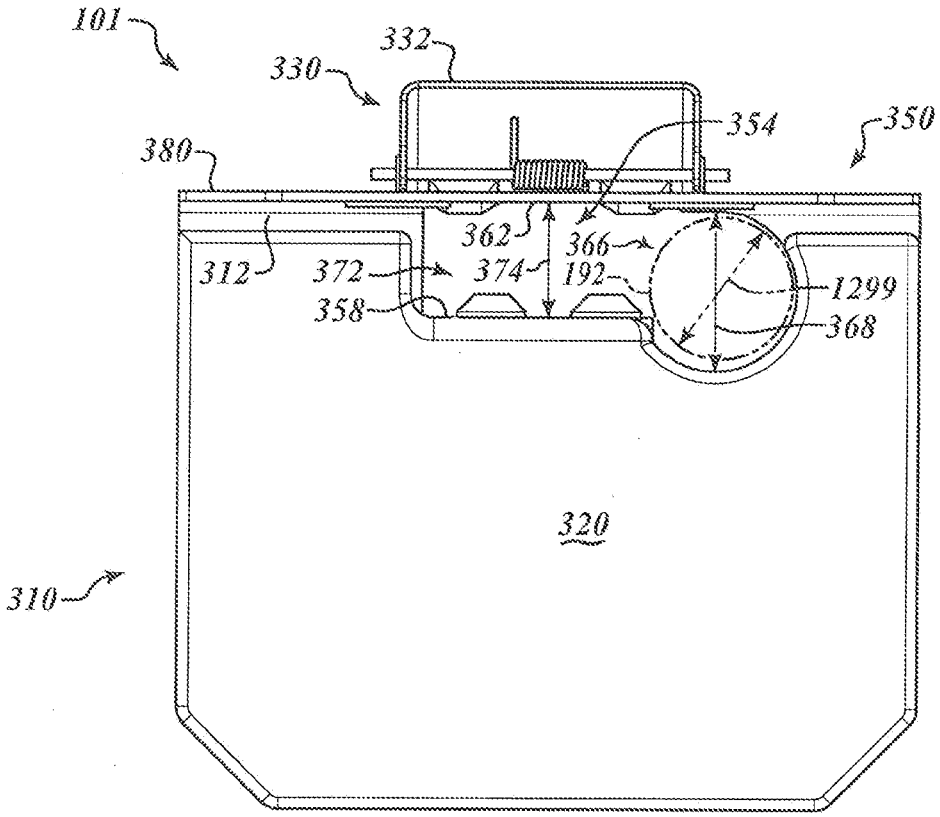
FIG. 12 is a schematic top view of one embodiment of a base tip of a base member of the assistive device of FIG. 1 disposed in an insertion portion of a mounting aperture of the limb-support assembly of FIG. 1, according to the invention.

FIG. 3 shows a schematic exploded perspective view of one embodiment of the limb-support assembly 101. FIG. 4 shows a schematic perspective view of one embodiment of the limb-support assembly 101. FIG. 12 shows a schematic top view of one embodiment of the limb-support assembly 101.

The limb-support assembly 101 includes a weight-bearing member 310 and a mounting assembly 350. The weight-bearing member 310 is configured and arranged to receive a portion of a user's lower limb (see e.g., 218 in FIG. 2) and to elevate and provide physical support to the lower limb. The mounting assembly 350 is configured and arranged to couple the weight-bearing member 310 to the assistive device 186.

The weight-bearing member 310 has a perimeter that includes a first edge 312. The weight-bearing member 310 includes a receiving surface 316 configured to receive the user's lower limb. In at least some embodiments, the receiving surface 316 is planar (or substantially planar). In at least some embodiments, the weight-bearing member 310 is configured and arranged such that, when the limb-support assembly 101 is coupled to the assistive device 186 the plane of the receiving surface 316 is transverse to the longitudinal axis 176 of the assistive device 186. Optionally, one or more pads 320 are disposed over at least a portion of the receiving surface 316 to promote user comfort when the user's lower limb is resting on the receiving surface 316 of the weight-bearing member 310.

The mounting assembly 350 includes a mounting aperture 354 and a first mounting brace 380. The mounting aperture 354 is configured and arranged for receiving a portion of the assistive device 186, such as the base member 190, one or more of the support members 194 and 196, or both the base member 190 and one or more of the support members 194 and 196 (e.g., along the overlapping region 142). The mounting aperture 354 is positioned between the receiving surface 316 and the first mounting brace 380. In at least some embodiments, when the a portion of the assistive device 186 is received by the mounting aperture 354, the receiving surface 316 is disposed along the first side 178 of the assistive device 186, while the first mounting brace 380 is disposed along the second side 180 of the assistive device 186.

In at least some embodiments, the mounting aperture 354 is disposed along the weight-bearing member 310. In preferred embodiments, the mounting aperture 354 is disposed along the weight-bearing member 310 such that the receiving surface 316 has ample space for receiving the user's lower limb 218. In at least some embodiments, the mounting aperture 354 is positioned in proximity to the first edge 312 of the weight-bearing surface 310. In at least some embodiments, the mounting aperture 354 at least partially abuts the first edge 312 of the weight-bearing surface 310.

The first mounting brace 380 abuts the first edge 312 of the weight-bearing member 310. In at least some embodiments, the first mounting brace 380 additionally abuts the mounting aperture 354. In at least some embodiments, the first mounting brace 380 is continuous with the weight-bearing member 310 such that the first mounting brace 380 form a unitary, single-piece structure.

The first mounting brace 380 extends outwardly from the first end 312 of the weight-bearing member 310 above a plane formed by the receiving surface 316 of the weight-bearing member 310. In at least some embodiments, the first mounting brace 380 is perpendicular to the receiving surface 316.

As mentioned above, when the assistive device 186 is received by the mounting aperture 354 the receiving surface 316 is disposed along the first side 178 of the assistive device and the first mounting brace 380 is disposed along the second side 180 of the assistive device 186. In at least some embodiments, when the assistive device 186 is received by the mounting aperture 354, and when the user 200 places his or her lower limb 218 on the receiving surface 316 of the weight-bearing member 310, the weight of the user's lower limb 218 causes at least a portion of the first mounting brace 380 to press against the second side 180 of the assistive device 186, thereby holding the limb-support assembly 101 in position relative to the assistive device 186.

As shown in FIG. 1, the assistive device 186 may include a base tip 192 with a diameter that is larger than a diameter of other portions of the base member 190. In which case, the mounting aperture may need to accommodate the wider diameter of the base tip when inserting the assistive device into the mounting aperture. Once the assistive device is received by the mounting aperture, however, the wider diameter needed to accommodate the base tip may be undesirable during use of the assistive device because the wider diameter may reduce (or even prevent) retention of the assistive device by the limb-support assembly.

One way to deal with this problem is to include two portions in the mounting aperture; for example, a portion having a relatively-large diameter for use during insertion and removal of the assistive device; and another portion having a relatively-small width for retaining the assistive device during use. In which case, the assistive device may be inserted into the insertion portion of the mounting aperture, and then slid to the retention portion of the mounting aperture during use.

In at least some embodiments, the mounting aperture 354 includes an insertion portion 366 and a retention portion 372 that are continuous with one another. The insertion portion 366 is configured and arranged to receive the assistive device 186 when the assistive device 186 is inserted into, or removed from, the limb-support assembly 101. In at least some embodiments, the insertion portion 366 is configured to receive the assistive device 186 from the second end portion 174 of the assistive device 186 and slide along the assistive device 186 to a desired position along the longitudinal axis 176 of the assistive device 186.

The insertion portion 366 of the mounting aperture 354 has a diameter 368. In at least some embodiments, the diameter 368 of the insertion portion 366 is larger than the diameter 191 of the base member 190 of the assistive device 186. In at least some embodiments, the diameter 368 of the insertion portion 366 is larger that a largest diameter of the assistive device 186 along the second end portion 174 of the assistive device 186. FIG. 12 shows the base tip 192 of the assistive device 186 disposed in the insertion portion 366 of the mounting aperture 354. The base tip 192 is shown in FIG. 12 as having a diameter 1299. As shown in FIG. 12, in at least some embodiments the diameter 368 of the insertion portion 366 is larger than the diameter 1299 of the base tip 192 of the assistive device 186.

In at least some embodiments, once the assistive device 186 is disposed in the insertion portion 366 of the mounting aperture 354 beyond the base tip 192, the assistive device 186 may be slid laterally with respect to the longitudinal axis 176 of the assistive device 186 to dispose the assistive device 186 in the retention portion 372 of the mounting aperture 354. The assistive device 186 may be adjusted to a desired position along the longitudinal axis 176 of the assistive device 186 while the assistive device 186 is disposed in either the insertion portion 366 or the retention portion 372. In at least some embodiments, the desired position along the longitudinal axis 176 of the assistive device 186 may be disposed along the overlapping portion (142 in FIG. 1) of the assistive device 142. In which case, the assistive device 186 may only be able to slide into the retention portion 372 when the assistive device 186 is rotationally-oriented with respect to the limb-support assembly 101 such that the axillary support 198 is parallel to the first mounting brace 380. Having the axillary support 198 parallel with the first mounting brace 380 ensures that the limb-support assembly 101 is properly oriented with the opposing first and second sides 178 and 180, respectively, of the assistive device 186.

The retention portion 372 of the mounting aperture 354 has a first edge 358 and an opposing second edge 362, where the second edge 362 is closer to the first mounting brace 380 than the first edge 358. In at least some embodiments, the first mounting brace 380 abuts the second edge 362 of the retention portion 372 of the mounting aperture 354. The retention portion 372 is configured and arranged to receive the assistive device 186 such that the first side 178 of the assistive device 186 abuts the first edge 358 of the retention portion 372 and the second side 180 of the assistive device 186 abuts the second edge 362 of the retention portion 372.

The retention portion 372 of the mounting aperture 354 has a width 374 forming the shortest distance between the first edge 358 and the second edge 362 of the retention portion 372. In at least some embodiments, the width 374 of the retention portion 374 is smaller than the diameter 368 of the insertion portion 366. In at least some embodiments, the width 374 of the retention portion 374 is larger than the diameter 191 of the base member 190 of the assistive device 186. In at least some embodiments, the width 374 of the retention portion 374 is smaller than the diameter 1299 of the base tip 192 of the assistive device 186. In at least some embodiments, the width 374 of the retention portion 372 is larger than the diameter 191 of the base member 190 of the assistive device 186 and smaller than the diameter 1299 of the base tip 192 of the assistive device 186.

In at least some embodiments, the mounting assembly 350 includes a second mounting brace 390 for facilitating retention of the assistive device 186 when the assistive device 186 is received by the retention portion 372 of the mounting aperture 354. The second mounting brace 390 may be used to increase the surface area abutting the first side 178 of the assistive device, thereby increasing the surface along which force is acted upon when weight is placed on the receiving surface 316 and the first mounting brace 380 is pressing against the second side 180 of the assistive device 186.

The second mounting brace 390 extends outwardly from the weight-bearing member 310 below a plane formed by the receiving surface 316 of the weight-bearing member 310. In at least some embodiments, the first mounting brace 380 is perpendicular to the receiving surface 316. In at least some embodiments, the second mounting brace 390 abuts the first edge 358 of the retention portion 372 of the mounting aperture 354.

When the assistive device 186 is received by the mounting aperture 354, the second mounting brace 390 is disposed along the first side 178 of the assistive device 186. In at least some embodiments, when the assistive device 186 is received by the mounting aperture 354, and when the user 200 places his or her lower limb 218 on the receiving surface 316 of the weight-bearing member 310, the weight of the user's lower limb 218 causes at least a portion of the second mounting brace 390 to press against the first side 178 of the assistive device 186, thereby holding the limb-support assembly 101 in position relative to the assistive device 186. In at least some embodiments, one or more mounting pads 394 are disposed along one or more surfaces of the second mounting brace 390 that press against the first side 178 of the assistive device 186.

In at least some embodiments, the positioning of the limb-support assembly 101 along the longitudinal axis 176 of the assistive device 186 is retainable without force being applied to the weight-bearing surface. In at least some embodiments, the limb-support assembly 101 includes a clip assembly 330 for maintaining a desired positioning of the limb-support assembly 101 along the longitudinal axis 176 of the assistive device 186.

The clip assembly 330 can be configured in any suitable way to releasably maintain the positioning of the limb-support assembly 101 along the longitudinal axis 176 of the assistive device 186. In at least some embodiments, the clip assembly 330 includes a pivotable arm 332 and a biased pivot pin 334. In at least some embodiments, the biased pivot pin 334 is biased by one or more springs.

The pivotable arm 332 is configured and arranged to pivot along an axis formed by the biased pivot pin 334 and apply a force against the assistive device 186 when the assistive device 186 is disposed in the mounting aperture 354. In at least some embodiments, the pivotable arm 332 is configured and arranged to apply force against the second side 180 of the assistive device 186. In at least some embodiments, the pivotable arm 332 is mounted to the first mounting brace 380. In which case, the clip assembly 330 may include mounting features for mounting the pivotable arm 332 to the first mounting brace 380, as well as for mounting the biased pivot pin 334 to the pivotable arm 332. In FIG. 3, the mounting features are shown as including apertured brackets 336 disposed along the pivotable arm 332 and apertured brackets 338 insertable through slits 342 defined in the first mounting brace 380.

In at least some embodiments, when the pivotable arm 332 applies a force against the second side 180 of the assistive device 186, the force is applied along a portion of the assistive device 186 that is extended beneath the receiving surface 316 of the weight-bearing member 310. In at least some embodiments, the clip assembly 330 works in cooperation with the second mounting brace 390 to squeeze the assistive device 186 between the pivotable arm 332 and the second mounting brace 390. In at least some embodiments, one or more mounting pads 344 are disposed along one or more surfaces of the second mounting brace 390 that press against the first side 178 of the assistive device 186.

Figure 5:
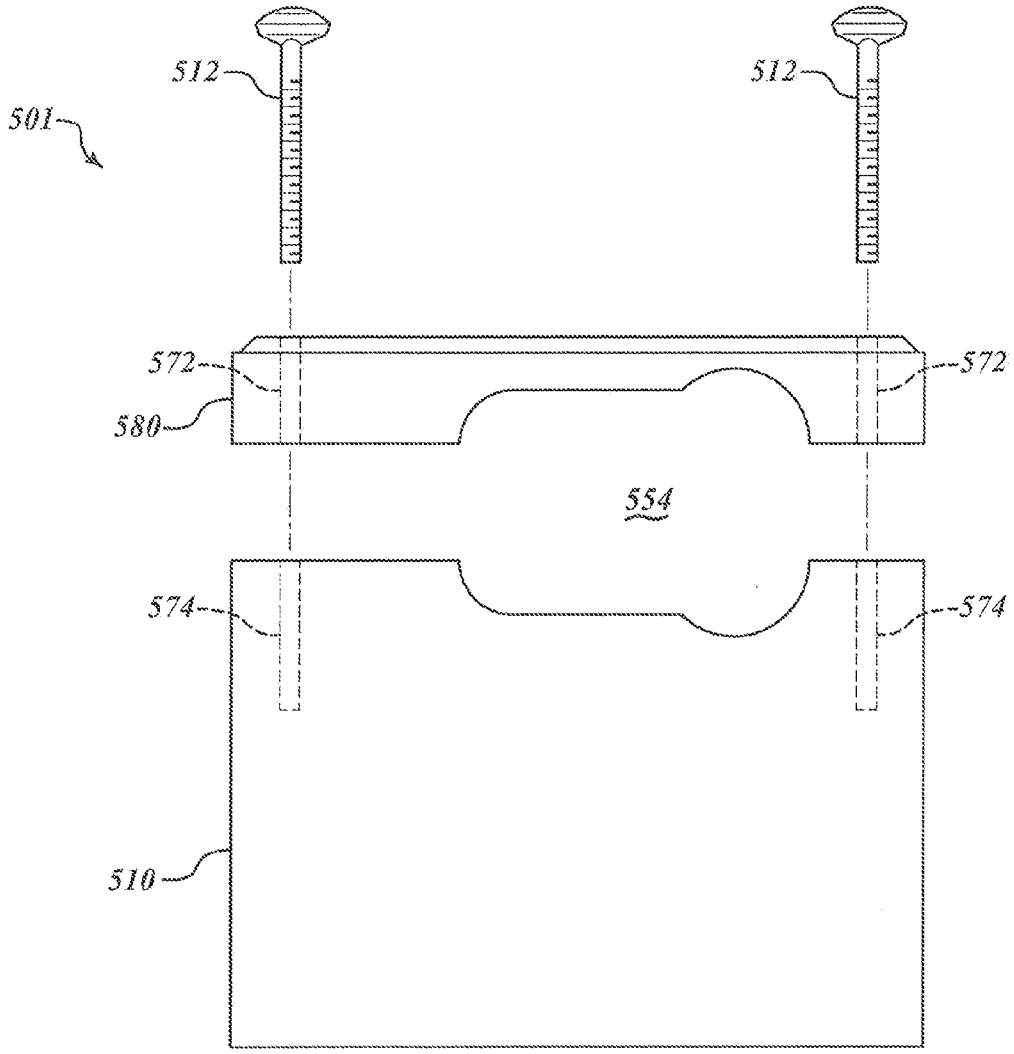
FIG. 5 is a schematic top view of another embodiment of a limb-support assembly having a first mounting brace and a weight-bearing member, where the first mounting brace is at least partially separable from the weight-bearing member, according to the invention.
Figure 6:
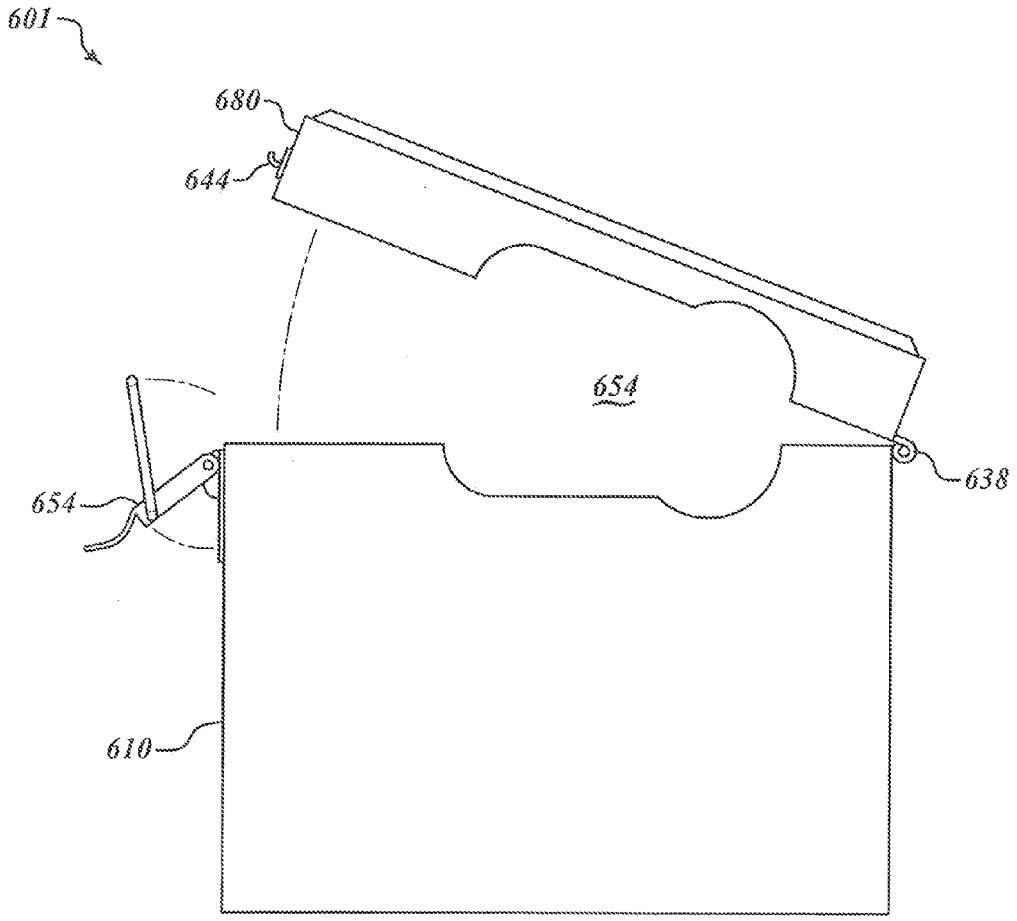
FIG. 6 is a schematic top view of yet another embodiment of a limb-support assembly having a first mounting brace and a weight-bearing member, where the first mounting brace is at least partially separable from the weight-bearing member, according to the invention.
Figure 7:
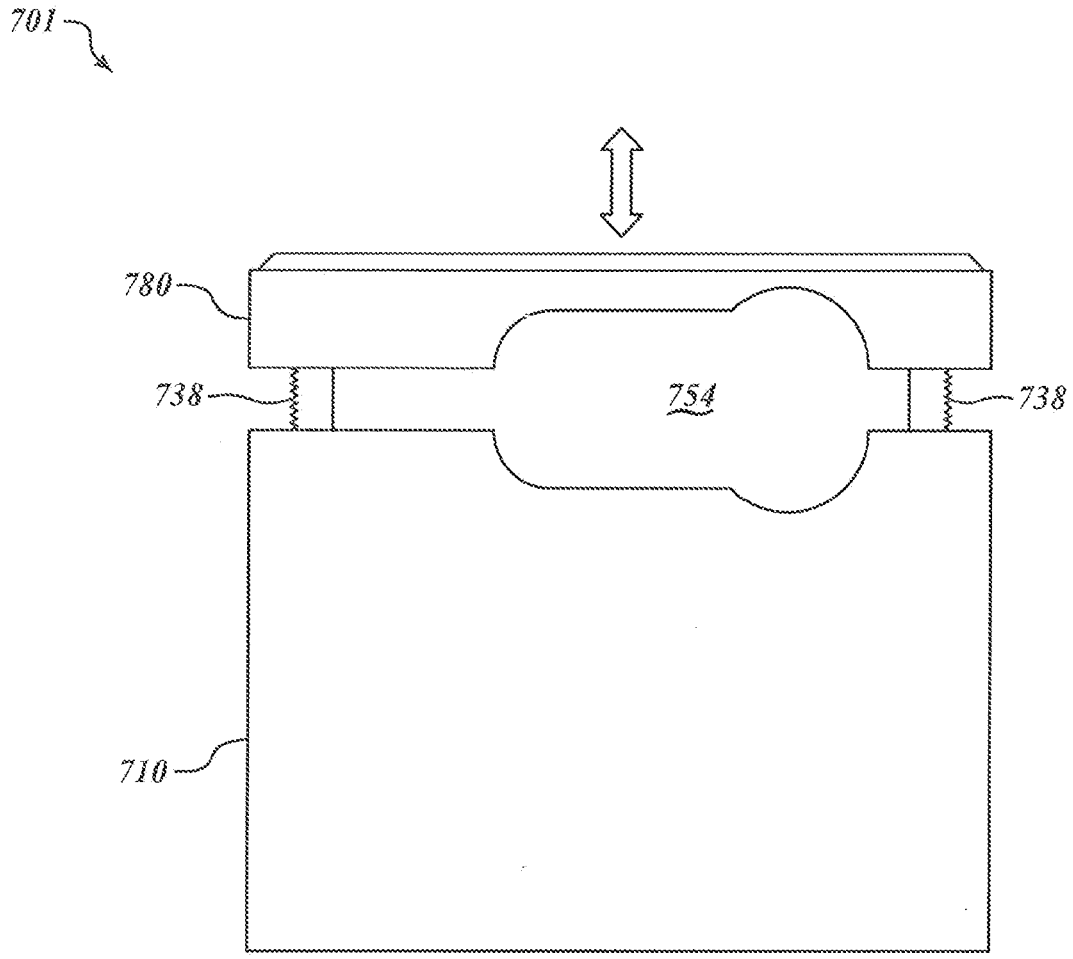
FIG. 7 is a schematic top view of another embodiment of a limb-support assembly having a first mounting brace and a weight-bearing member, where the first mounting brace is at least partially separable from the weight-bearing member, according to the invention.

In FIGS. 3, 4, and 12, the limb-support assembly is shown with the weight-bearing member and the first mounting brace formed as a unitary, single-piece, continuous structure. FIGS. 5-7 show several alternate embodiments of the limb-support assembly where the weight-bearing member and the first mounting brace are formed as separate, or at least partially separatable, elements that are coupleable to one another. In at least some embodiments, the mounting apertures shown in FIGS. 5-7 are partially disposed along the first mounting brace and partially disposed along the weight-bearing member.

FIG. 5 shows a schematic top view of one embodiment of a multi-element limb-support assembly 501. The limb-support assembly 501 includes a weight-bearing member 510 and a first mounting brace 580 that is coupleable to the weight-bearing member 510. In FIG. 5, one or more fasteners 512 (e.g., screws, bolts, nails, pins, or the like) are shown that are insertable into fastener-receiving channels 572 defined in the first mounting brace 580, and fastener-receiving channels 574 defined in the weight-bearing member 510.

A mounting aperture 554 is defined in the limb-support assembly 501. In at least some embodiments, the mounting aperture 554 is entirely disposed along the first mounting brace 580. In at least some embodiments, the mounting aperture 554 is entirely disposed along the weight-bearing member 510. In at least some embodiments, the mounting aperture 554 is partially disposed along the first mounting brace 580 and partially disposed along the weight-bearing member 510. In which case, the mounting aperture 554 is not completely enclosed until the weight-bearing member 510 and the first mounting brace 580 are coupled together.

FIG. 6 shows a schematic top view of another embodiment of a multi-element limb-support assembly 601. The limb-support assembly 601 includes a weight-bearing member 610 and a first mounting brace 680. In FIG. 6, the first mounting brace 680 is coupled to the weight-bearing member 610 via a hinge 638. The first mounting brace 680 is pivotable along the hinge 638 to transition between an open position (as shown in FIG. 6) and a closed position (where the first mounting brace 680 and the weight-bearing member 610 abut one another along a length).

A mounting aperture 654 is defined in the limb-support assembly 601. In at least some embodiments, the mounting aperture 654 is entirely disposed along the first mounting brace 680. In at least some embodiments, the mounting aperture 654 is entirely disposed along the weight-bearing member 610. In at least some embodiments, the mounting aperture 654 is partially disposed along the first mounting brace 680 and partially disposed along the weight-bearing member 610. In which case, the mounting aperture 654 is not completely enclosed until the weight-bearing member 610 and the first mounting brace 680 are coupled together (i.e., when the first mounting brace 680 is pivoted to a closed position).

In at least some embodiments, the limb-support assembly 601 includes a retention system for removably retaining the limb-support assembly 601 in a closed position. In FIG. 6, the retention system is shown as a buckle 654 and a buckle latch 644 configured and arranged to mate with the buckle 654, where the buckle 654 is disposed on one of the first mounting brace 680 or the weight-bearing member 610, and the buckle latch 644 is disposed on the other of the first mounting brace 680 or the weight-bearing member 610.

FIG. 7 shows a schematic top view of yet another embodiment of a multi-element limb-support assembly 701. The limb-support assembly 701 includes a weight-bearing member 710 and a first mounting brace 780. In FIG. 7, one or more biasing elements, such as springs 738, are disposed along abutting surfaces of the weight-bearing member 710 and the first mounting brace 780. The biasing elements 738 are configured and arranged to maintain the weight-bearing member 710 and the first mounting brace 780 coupled to one another unless a force is applied to one or more of the weight-bearing member 710 or the first mounting brace 780 (or both) to separate the two from one another (as shown in FIG. 7).

A mounting aperture 754 is defined in the limb-support assembly 701. In at least some embodiments, the mounting aperture 754 is entirely disposed along the first mounting brace 780. In at least some embodiments, the mounting aperture 754 is entirely disposed along the weight-bearing member 710. In at least some embodiments, the mounting aperture 754 is partially disposed along the first mounting brace 780 and partially disposed along the weight-bearing member 710. In which case, the mounting aperture 754 is not completely enclosed until the weight-bearing member 710 and the first mounting brace 780 are coupled together.

In each of FIGS. 5-7, the mounting aperture is shown partially disposed along the first mounting brace and partially disposed along the weight-bearing member. It may be advantageous to form the mounting aperture such that it is partially disposed on each of the first mounting brace and the weight-bearing member to enable the limb-support member to be used with assistive devices having an oversized base tip, or base member, or other portion, that would be too large to fit in the mounting aperture without partially separating the opposing sides of the mounting aperture, thereby widening the mounting aperture enough to accommodate the assistive device.

Figure 8:
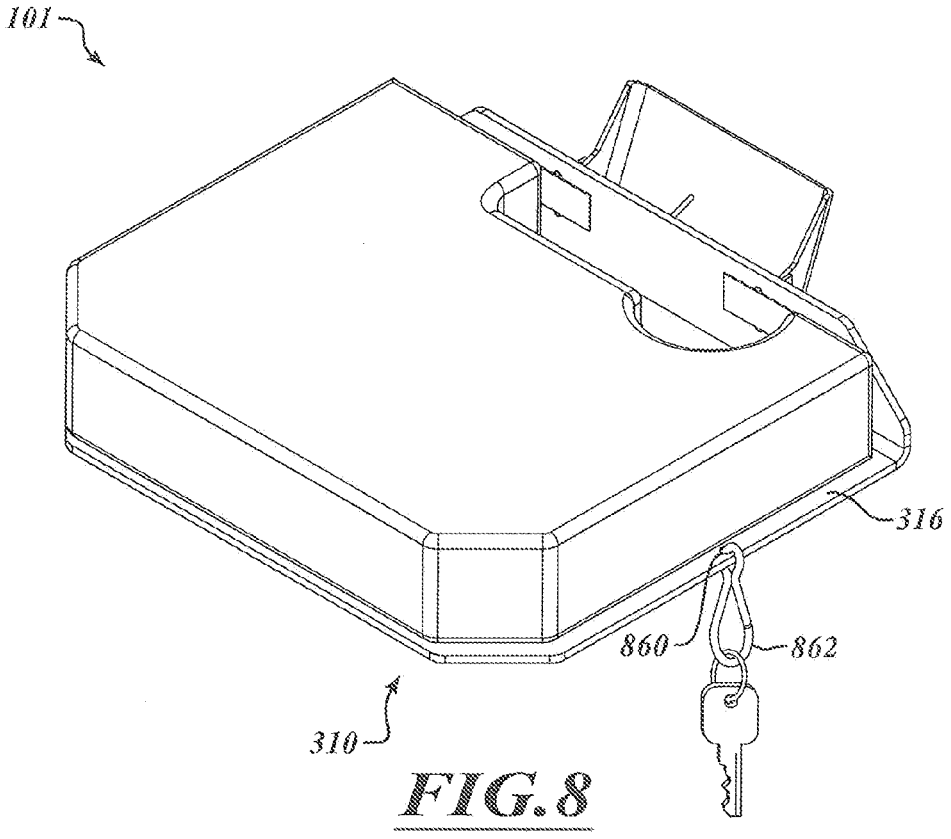
FIG. 8 is a schematic perspective view of one embodiment of the limb-support assembly of FIG. 1, the limb-support assembly including a weight-bearing member defining a utility aperture configured for receiving a carabineer, according to the invention.

Turning to FIGS. 8-11, in at least some embodiments the limb-support assembly is configured and arranged to receive one or more items in addition to the lower limb of the user. FIG. 8 shows a perspective view of one embodiment of the limb-support assembly 101 that includes one or more utility apertures 860. The utility aperture(s) 860 may be defined along any suitable portion of the limb-support assembly 101 including, for example, the weight-bearing member, the first support brace, the second support brace, the clip assembly, or the like or combinations thereof. In FIG. 8, the utility aperture 860 is shown disposed along the first receiving surface 316 of the weight-bearing member 310.

The utility aperture 860 can be formed with any suitable diameter. In FIG. 8, the utility aperture 860 is sized to receive a carabineer 862. Alternately, the utility aperture 860 is configured and arranged to receive one or more key rings, hooks, chains, latches, fobs, or the like or combinations thereof.

Figure 9:
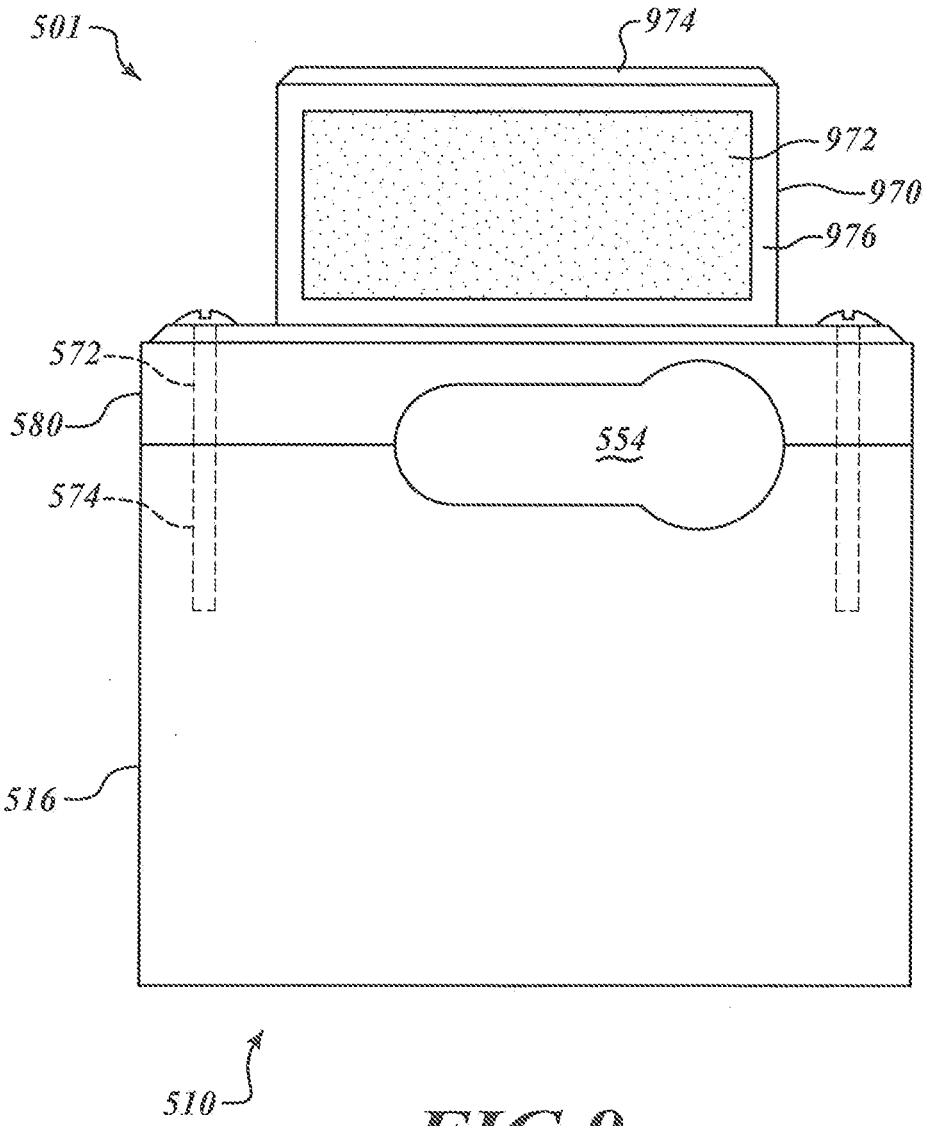
FIG. 9 is a schematic top view of one embodiment of the limb-support assembly of FIG. 5 including a utility platform coupled to a first mounting brace of the limb-support assembly, according to the invention.

FIG. 9 shows a perspective view of one embodiment of the limb-support assembly 501 with a utility platform 970 disposed along the first mounting brace 580. In at least some embodiments, the utility platform 970 is removable. In at least some embodiments, the utility platform 970 is used in lieu of the clip assembly 330. In at least some embodiments, the utility platform 970 is rigidly coupled to the pivotable arm 332 of the clip assembly 330 such that the user may pivot the pivotable arm 332 via the utility platform 970. Alternately, in at least some embodiments the limb-support assembly 501 includes both the clip assembly 330 and the utility platform 970.

In at least some embodiments, the utility platform 970 is foldable such that when in use, the utility platform 970 extends substantially in a plane parallel to a plane of the receiving surface 516 of the limb-support assembly 501, while when not in use, the utility platform 970 folds along a hinge, not shown, to lie substantially perpendicular to the plane of the receiving surface 516. The utility platform 970 may be configured and arranged to hold any suitable number of items including, for example, sunglasses, mobile devices, handbags (see e.g., FIG. 10), grocery bags (see e.g., FIG. 11), backpacks, or the like or combinations thereof, while the user uses the assistive device 186 to which the limb-support assembly is attached.

The utility platform 970 may, optionally, include a gripping surface 972 to place objects upon. The gripping surface 972 may include a gripping texture that increases the gripping friction between the utility platform 970 and the objects placed upon it. The gripping surface 972 may be fabricated from rubber, plastic, or any other such materials that may provide gripping friction. The gripping texture may include dimples or other features that increase the gripping friction. The utility platform 970 may, optionally, include a lip 974 around at least one edge of the utility platform 970 that may prevent an object from falling from the utility platform 970. Optionally, a smooth or decorative surface 976 may surround the gripping surface 972.

Figure 10:
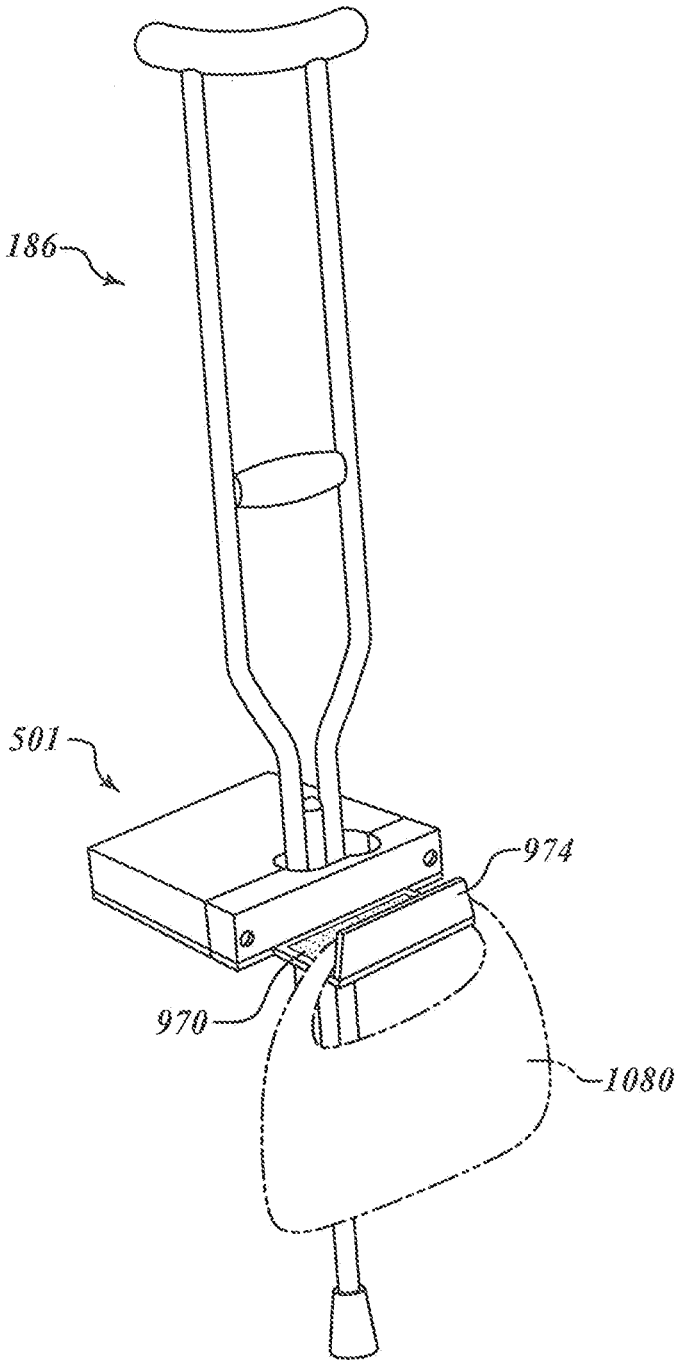
FIG. 10 is a schematic perspective view of one embodiment of the limb-support assembly of FIG. 9 coupled to the assistive device of FIG. 1, the limb-support assembly including a utility platform configured to receive a handbag, according to the invention.

FIG. 10 is a schematic perspective view of one embodiment of the limb-support assembly 501 coupled to the assistive device 186. The limb-support assembly 501 includes the utility platform 970 attached thereto. The utility platform 970 includes the lip 974. A handbag 1080 is shown in FIG. 10 hanging from the utility platform 970 and prevented from sliding off of the utility platform by the lip 974.

Figure 11:
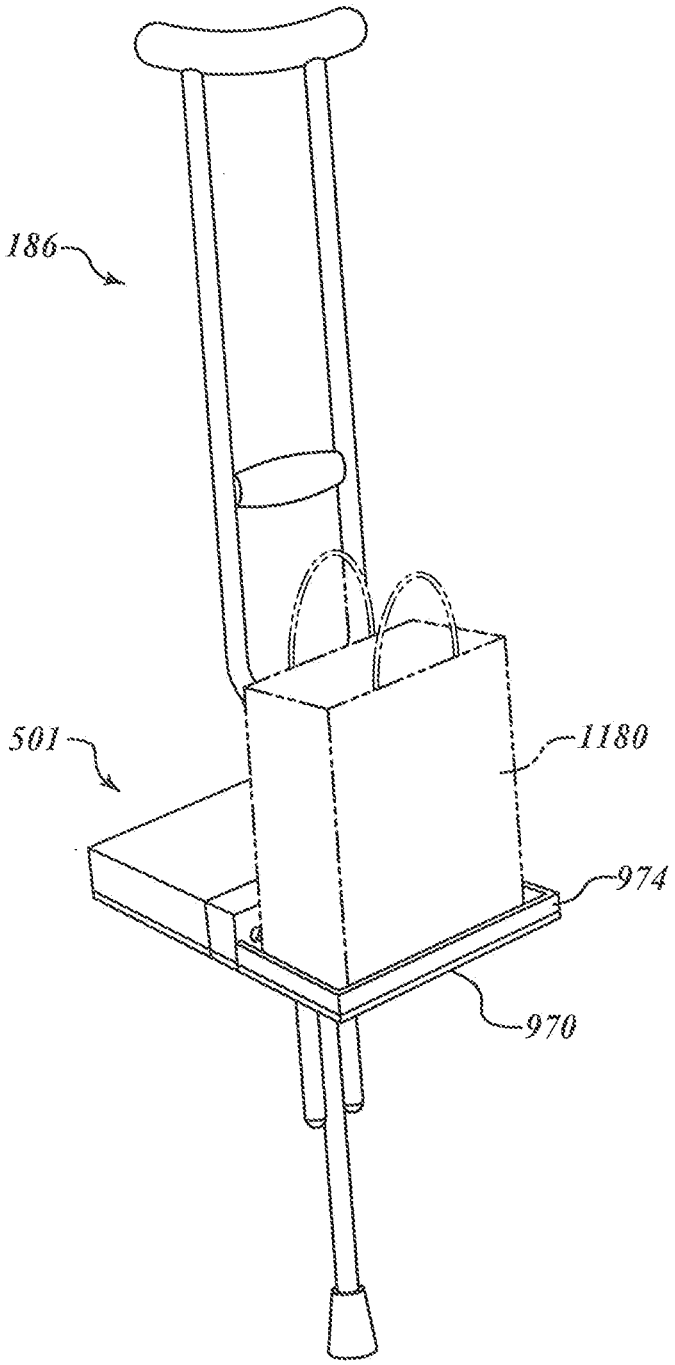
FIG. 11 is a schematic perspective view of one embodiment of the limb-support assembly of FIG. 9 coupled to the assistive device of FIG. 1, the limb-support assembly including a utility platform configured to receive a grocery bag, according to the invention.

FIG. 11 is a schematic perspective view of one embodiment of the limb-support assembly 501 coupled to the assistive device 186. The limb-support assembly 501 includes the utility platform 970 attached thereto. The utility platform 970 includes the lip 974. A grocery bag 1180 is shown in FIG. 11 resting on the utility platform 970 and prevented from sliding off of the utility platform by the lip 974.

The above specification, examples and data provide a description of the manufacture and use of the composition of the invention. Since many embodiments of the invention can be made without departing from the spirit and scope of the invention, the invention also resides in the claims hereinafter appended.

What is claimed as new and desired to be protected by Letters Patent of the United States is:

1. A limb-support assembly adapted for use with an assistive device, the limb-support assembly comprising:

a weight-bearing member having a perimeter with a first edge, the weight-bearing member comprising a planar receiving surface configured and arranged for receiving a portion of a lower limb of a user; and a mounting assembly configured and arranged for removably coupling the weight-bearing member to an assistive device, the mounting assembly comprising a first mounting brace extending outwardly from the first edge of the weight-bearing member with the first mounting brace extending above the receiving surface, and a mounting aperture defined in the weight-bearing member between the first mounting brace and the receiving surface and having an insertion portion with a diameter that is larger than a base tip of a portion of the assistive device, the mounting aperture configured and arranged for receiving the base tip of the portion of the assistive device through the insertion portion of the mounting aperture, wherein the mounting aperture comprises the insertion portion and a retention portion continuous with the insertion portion, the retention portion having first and second opposing edges, and wherein the second edge of the retention portion abuts the first mounting brace.

2. The limb-support assembly of claim 1, wherein when a portion of the assistive device is received by the mounting aperture, and when weight is placed on the receiving surface, the first mounting brace is configured and arranged to press against an opposing side of the assistive device from the receiving surface to retain the positioning of the assistive device relative to the limb-support assembly.

3. The limb-support assembly of claim 1, wherein the first mounting brace extends outwardly from the first edge of the weight-bearing member in a direction that is perpendicular to the receiving surface.

4. The limb-support assembly of claim 1, wherein the first mounting brace abuts the mounting aperture.

5. The limb-support assembly of claim 1, further comprising a second mounting brace extending outwardly from a first edge of a retention portion of the mounting aperture.

6. The limb-support assembly of claim 1, wherein a second mounting brace extends outwardly from a first edge of a retention portion of the mounting aperture in a direction that is perpendicular to the receiving surface.

7. The limb-support assembly of claim 1, wherein when the portion of the assistive device is received by the mounting aperture, and when weight is placed on the receiving surface of the weight-bearing member, a second mounting brace is configured and arranged to press against the same side of the assistive device as the weight-bearing member.

8. The limb-support assembly of claim 1, wherein a second mounting brace extends outwardly from a first edge of a retention portion of the mounting aperture beneath the receiving surface of the weight-bearing member.

9. The limb-support assembly of claim 1, further comprising a clip assembly for facilitating removable retention of the limb-support assembly along a longitudinal axis of the assistive device when the assistive device is received by the mounting aperture.

10. The limb-support assembly of claim 9, wherein the clip assembly is mounted to the first mounting brace.

11. The limb-support assembly of claim 9, wherein the clip assembly comprises a pivotable arm extending beneath the receiving surface.

12. The limb-support assembly of claim 9, wherein the clip assembly comprises a pivotable arm configured and arranged to apply a force against the assistive device when the assistive device is received by the mounting aperture, the applied force squeezing the assistive device between the pivotable arm and a second mounting brace.

13. An assistive system comprising an assistive device for facilitating mobility of a user, the assistive device having a first side, an opposing second side, and a longitudinal axis, the assistive device comprising:

a body support assembly comprising at least one body support, and a base member coupled to the body support assembly, the base member having a first end and a base-member diameter; and a limb-support assembly removably coupleable to the assistive device, the limb-support assembly comprising:

a weight-bearing member comprising a planar receiving surface, the receiving surface configured and arranged for receiving a portion of a lower limb of the user, and a mounting assembly configured and arranged for removably coupling the weight-bearing member to the assistive device, the mounting assembly comprising a first mounting brace extending outwardly from a first edge of the weight-bearing member with the first mounting brace extending above the receiving surface, and a mounting aperture defined in the weight-bearing member between the first mounting brace and the receiving surface, the mounting aperture configured and arranged for receiving a portion of the assistive device with the first side of the assistive device abutting the receiving surface and the second side of the assistive device abutting the first mounting brace, wherein a base tip is disposed at the first end of the base member, and wherein the mounting aperture comprises an insertion portion having a diameter that is larger than a diameter of the base tip.

14. The assistive system of claim 13, wherein the diameter of the base tip is larger than the base-member diameter.

15. The assistive system of claim 13, wherein the mounting aperture comprises a retention portion that is continuous with the insertion portion.

16. The assistive system of claim 13, wherein the mounting aperture comprises a retention portion having a width that is smaller than the diameter of the base tip.

17. The assistive system of claim 13, wherein the mounting aperture comprises a retention portion having a width that is smaller than the diameter of the base tip and larger than the base-member diameter.

18. A method for attaching a limb-support assembly to an assistive device, the method comprising:

providing an assistive device for facilitating mobility of a user, the assistive device comprising a base member;

providing a limb-support assembly comprising a weight-bearing member and a mounting assembly, the mounting assembly comprising a mounting aperture and a first mounting brace extending outwardly from a first edge of the mounting aperture above a limb-receiving surface of the weight-bearing member;

extending the base member of the assistive device through an insertion portion of the mounting aperture;

sliding the limb-support assembly along a longitudinal length of the assistive device to a desired location along the base member; and sliding the base member along the mounting aperture from the insertion portion to a retention portion of the mounting aperture.

* * * * *